US005647761A

United States Patent [19]

Kaminski

[11] Patent Number: 5,647,761

[45] Date of Patent: Jul. 15, 1997

[54] LAMP BULB HOLDER AND A METHOD OF ASSEMBLING A LAMP BULB HOLDER

[75] Inventor: Christopher Kaminski, North Devon, Great Britain

[73] Assignee: The Whitaker Corporation, Wilmington, Del.

[21] Appl. No.: 523,973

[22] Filed: Sep. 6, 1995

[30] Foreign Application Priority Data

Sep. 6, 1994 [GB] United Kingdom ..... 9417867

[51] Int. Cl.[6] ..... H01R 4/26

[52] U.S. Cl. ..... 439/419; 439/699.2; 439/620

[58] Field of Search ..... 439/699.2, 419, 439/620, 397–400, 918

[56] References Cited

U.S. PATENT DOCUMENTS

| | | | |
|---|---|---|---|
| 4,820,956 | 4/1989 | Slobodzian et al. | 439/620 |
| 5,156,560 | 10/1992 | Thomas | 439/699.2 |
| 5,167,538 | 12/1992 | Stoerk | 439/620 |
| 5,286,223 | 2/1994 | Ogawa | 439/699.2 |
| 5,397,251 | 3/1995 | Kaminski | 439/699.2 |

FOREIGN PATENT DOCUMENTS

| | | | |
|---|---|---|---|
| 2 176 663 | 12/1986 | United Kingdom | H01R 33/945 |
| 2 229 326 | 9/1990 | United Kingdom | H01R 13/74 |

*Primary Examiner*—Neil Abrams
*Assistant Examiner*—Brian J. Biggi
*Attorney, Agent, or Firm*—Driscoll A. Nina

[57] ABSTRACT

A holder for a lamp bulb comprises an insulating housing having a terminal receiving part and a socket for the lamp bulb. The terminal receiving part defines first, second and third terminal receiving cavities opening into a terminal receiving end of the housing. One of the cavities receives an electrical terminal having a spring contact beam projecting into the socket for engaging one contact of the lamp bulb, and a slot receiving one lead of a diode. Another of the cavities receives an electrical terminal having a slot for receiving the other lead of the diode and a further slot for receiving a first supply lead. When these two terminals have been inserted into their cavities, a third terminal is inserted into its cavity, after the leads of the diode have been securely lodged in the diode receiving slots of the first two terminals. The third terminal has a spring contact beam which projects into the socket for engaging the other contact of the bulb, and a slot for receiving a second supply lead. All of the slots of the terminals open towards the terminal receiving end of the housing.

14 Claims, 10 Drawing Sheets

T
R
C1
C2
L
E
F
B
6
7
4
5
11
14
16
19
20
22
24
26
28
30
31
34
35
36
37
38
40
42
50
51
52
54

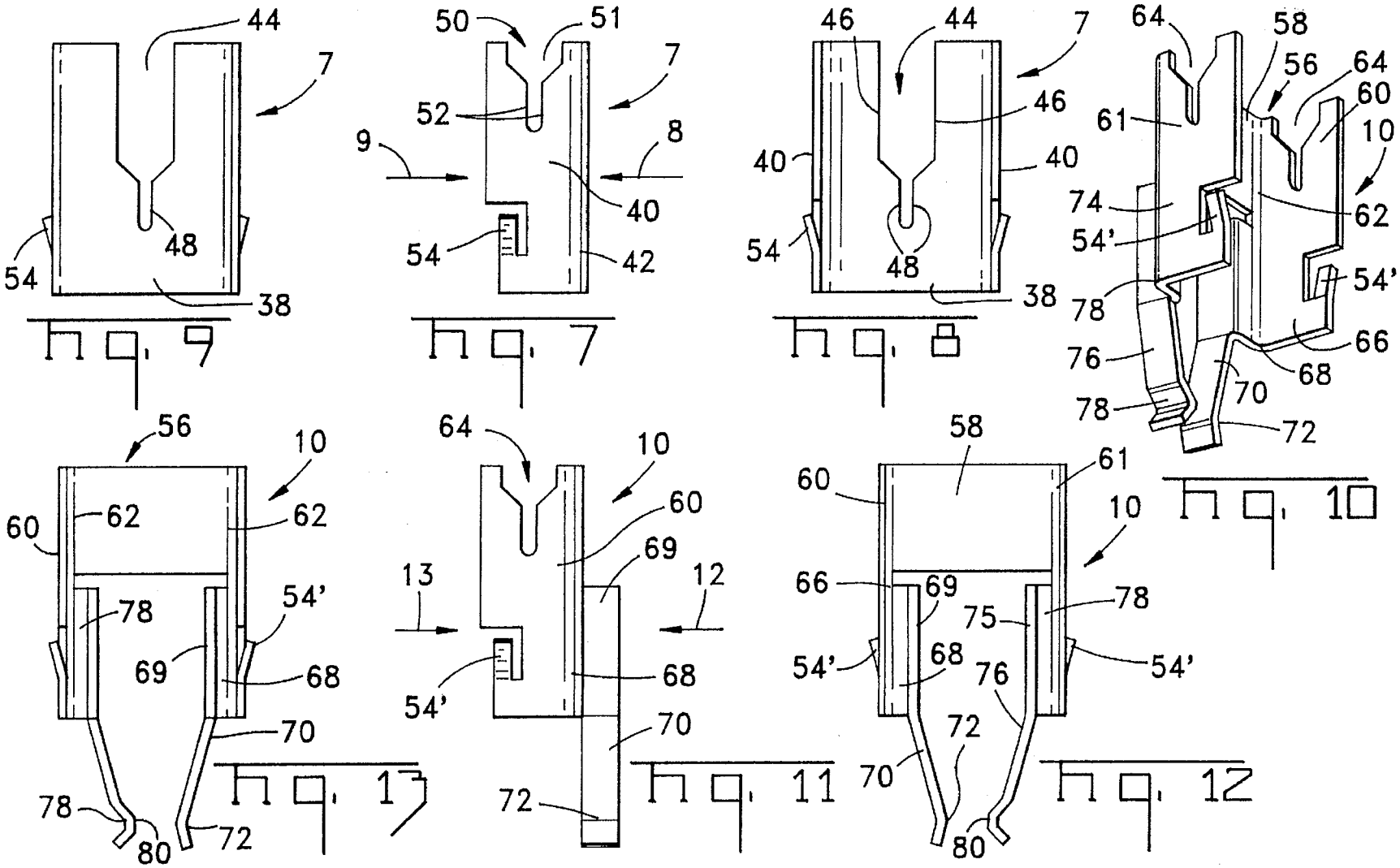
10
11
12
7
9
13
17

LAMP BULB HOLDER AND A METHOD OF ASSEMBLING A LAMP BULB HOLDER

BACKGROUND OF THE INVENTION

1. Field of the Invention

This invention relates to a lamp bulb holder and to a method of assembling a lamp bulb holder. The invention relates more specifically to the holders for baseless lamp bulbs.

2. Description of the Prior Art

For some applications, a lamp bulb is required to be connected to an electrical component, for example, a diode or a resistor. In one such application, where the lamp bulb has a coiled filament and is connected to a sensitive switching element, for example, a semiconductor chip, a diode is connected to the lamp bulb to protect the switching element from any back electromotive force that may be generated when the bulb is switched off, as a result of the decay of the magnetic flux about the filament. Such protection is needed, especially in coiled filament lamp bulbs that are continually switched on and off, for example, when the bulbs are installed as signal or indicator lamps in a gaming machine or automobile.

GB-A-2176663 discloses a lamp bulb holder comprising a housing and three electrical terminals which are inserted into respective cavities in the housing. Two of the terminals have slots for receiving respective leads of a solid state diode dropped onto a support in the housing before the insertion of the terminals. Two of the terminals also have spring contact beams which extend into a lamp bulb socket formed integrally with the housing, to engage respective contacts of the lamp bulb. Each of the three terminals has a pair of slots for receiving an external lead, the slots for receiving the external leads open towards a terminal receiving end of the housing but the slots for receiving the leads of the diode open in the opposite direction, that is to say towards the support upon which the diode is dropped. This known lamp bulb holder is clearly intended for manual assembly.

The present invention is intended to provide a lamp bulb holder and a method of assembling a lamp bulb holder, for automated assembly, by means of conventional terminal stitching machine.

SUMMARY OF THE INVENTION

According to one aspect of the invention, a holder for a lamp bulb comprises an insulating housing having a terminal receiving part and a socket for receiving the lamp bulb, the terminal receiving part defining first, second and third terminal receiving cavities opening into a terminal receiving end of the housing and receiving first, third and second electrical terminals, respectively, the first and third terminals each having a spring contact beam projecting into the socket for engaging a respective contact of the lamp bulb, the first and second terminals each having a component lead receiving slot securely receiving a respective lead of an electrical component and the second and third terminals each having at least one supply lead receiving slot, each of the component lead receiving slots and the supply lead receiving slots opening towards the terminal receiving end of the housing.

Thus, in automated assembly of the lamp bulb holder, an electrical component can be assembled to the first and second terminals, being firmly held in its assembled position against the action of any vibration, after which the third terminal is inserted into its cavity.

More firmly to secure the lamp bulb in the socket, each of the first and third terminals may have a spring retention beam for cooperation with the contact spring beam of the terminal to grip the lamp bulb, the spring beams and the retention beam straddling the electrical component.

In use in a gaming machine, where the lamp bulb holder may be subjected to particularly high vibration, the electrical component is secured in position by the engagement of the leads of the electrical component in the component lead receiving slots.

In a particularly compact embodiment of the lamp bulb holder, the second and third terminals have side walls lodged in opposed slots in opposite side walls of the housing and communicating with the third and second terminal receiving cavities respectively, the contact spring beam of the first terminal lying between the side walls of the third terminal and the spring contact beam of the third terminal lying between the side walls of the second terminal. Also in the interest of compactness each of the first and second end walls may be formed with a rabbet opening into the terminal receiving end of the housing and receiving the end of a respective lead of the electrical component.

In order to facilitate the insertion of the lamp bulb in the socket, the socket may comprise a pair of spaced cheeks depending from the terminal receiving part of the housing and each defining a first concave recess for guiding a respective side of the lamp bulb, a rib extending from each cheek into a space defined by a wall of the terminal receiving part of the housing, defining a second concave recess., coaxial with, but of smaller radius than, the first concave recess, for locating a contact bearing tail of the lamp bulb relative to contact surfaces of the spring contact beams.

According to another aspect of the invention, a method of assembling a holder for a lamp bulb comprises the steps of; providing an insulating housing having a terminal receiving part and a socket for receiving the lamp bulb, a terminal receiving part of the housing defining first, second and third successively arranged terminal receiving cavities opening into a terminal receiving end of the housing; inserting into the first cavity, by way of a terminal receiving end of the housing, a first electrical terminal having a first spring contact beam and a first component lead receiving slot, so that the spring contact beam projects into the socket of the housing for engaging a first contact of the lamp bulb and the component lead receiving slot opens towards the terminal receiving end of the housing; inserting into the third cavity, by way of the terminal receiving end of the housing, a second electrical terminal having a second component lead receiving slot and a first supply lead receiving slot, so that both of the slots open towards the terminal receiving end of the housing; inserting into the component receiving slots of the first and second terminals, by way of the terminal receiving face of the housing, respective leads of an electrical component so that the leads are gripped by the edges of the component lead receiving slot; and inserting into the second cavity a third electrical terminal having a second supply lead receiving slot and second spring contact beam, so that the second supply lead receiving slot opens towards the terminal receiving end of the housing and the spring contact beam is cammed aside by, passes the component and projects into the socket of the housing for engaging a second contact of the lamp bulb.

BRIEF DESCRIPTION OF THE DRAWINGS

FIG. 7 is a side view of the second terminal;

FIGS. 8 and 9 are views taken in the direction of the arrows 8 and 9, respectively, in FIG. 7;

FIG. 10 is an isometric view of a third electrical terminal of the lamp bulb holder;

FIG. 11 is a side view of the third terminal;

FIGS. 12 and 13 are views taken in the direction of the arrows 12 and 13, respectively, in FIG. 11;

FIGS. 23 to 27 are views similar to that of FIG. 14 but showing respective consecutive steps in stitching the terminals into the housing and assembling the lamp bulb to the lamp bulb holder so provided;

DETAILED DESCRIPTION OF THE PREFERRED EMBODIMENT

Figures 1, 2, 3, 4, 5, 6:
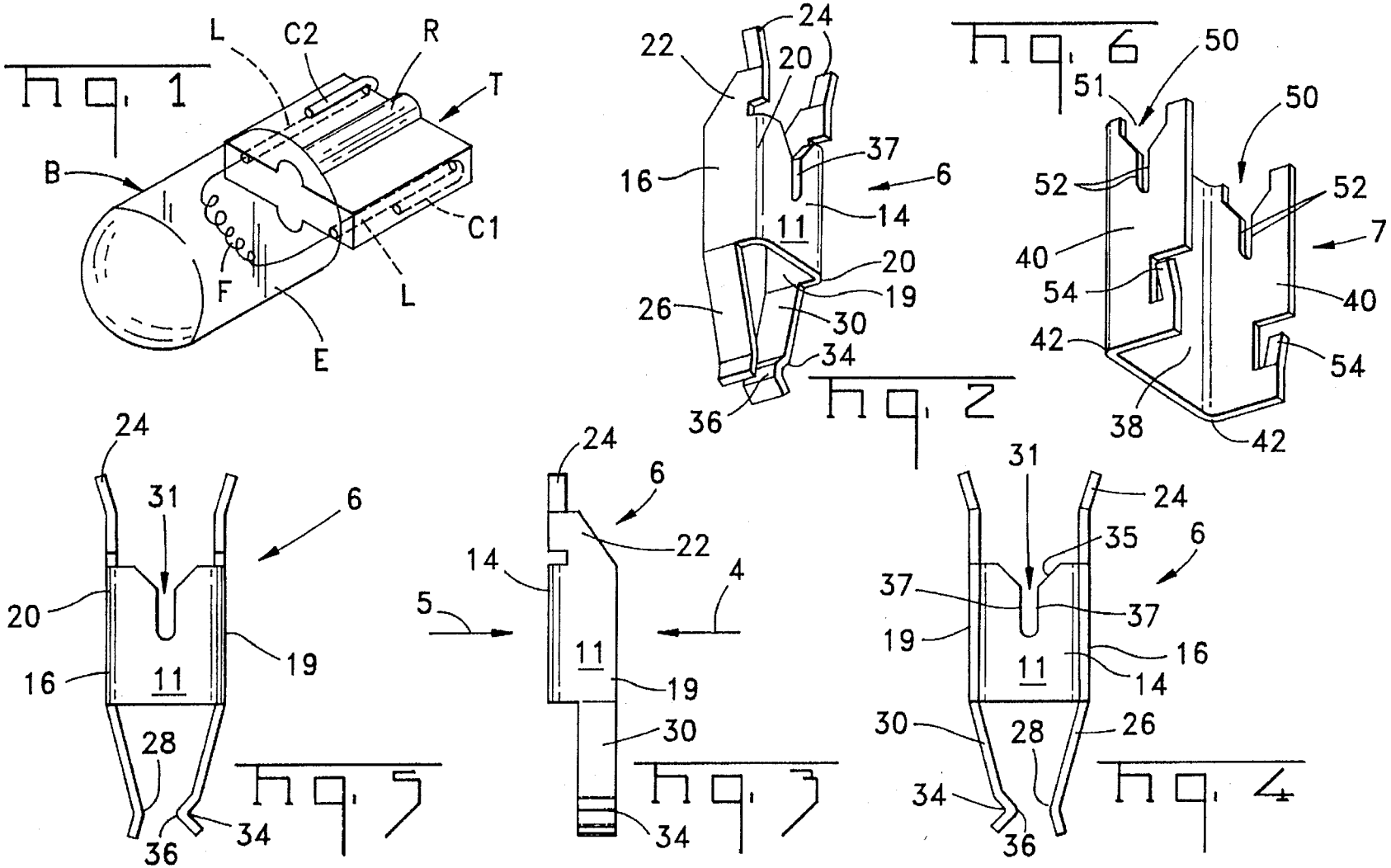
FIG. 1 is an isometric view of a baseless electric lamp bulb.
FIG. 2 is an isometric view of a first electrical terminal of a lamp bulb holder according to an embodiment of the present invention, for the lamp bulb of FIG. 1.
FIG. 3 is a side view of the first terminal.
FIGS. 4 and 5 are views taken in the direction of the arrows 4 and 5, respectively, in FIG. 3.
FIG. 6 is an isometric view of a second electrical terminal of the lamp holder.
Figure 14:
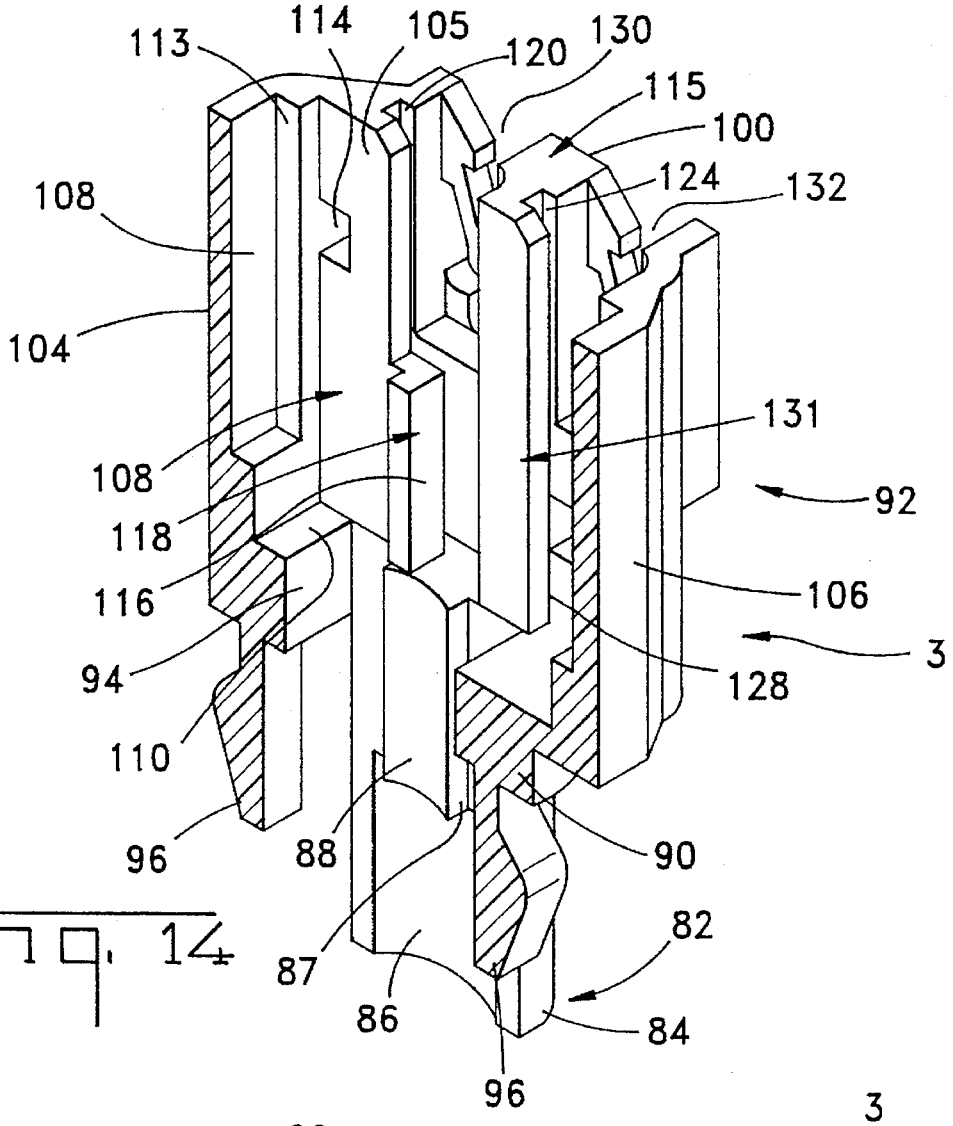
FIG. 14 is an isometric view partly in central longitudinal section of an insulating housing of the lamp bulb holder.
Figure 17:
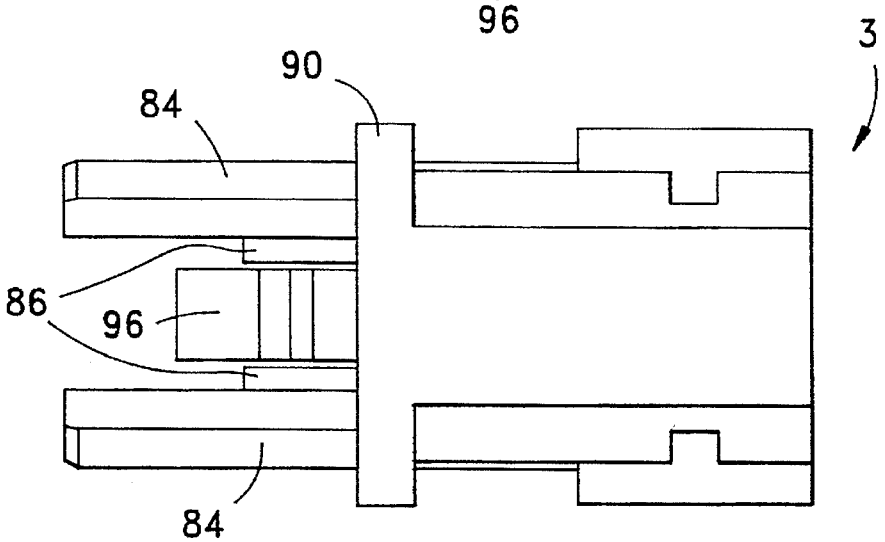
FIGS. 17 and 18 are views taken in the direction of the arrows 17 and 18, respectively, in FIG. 15.
Figure 15:
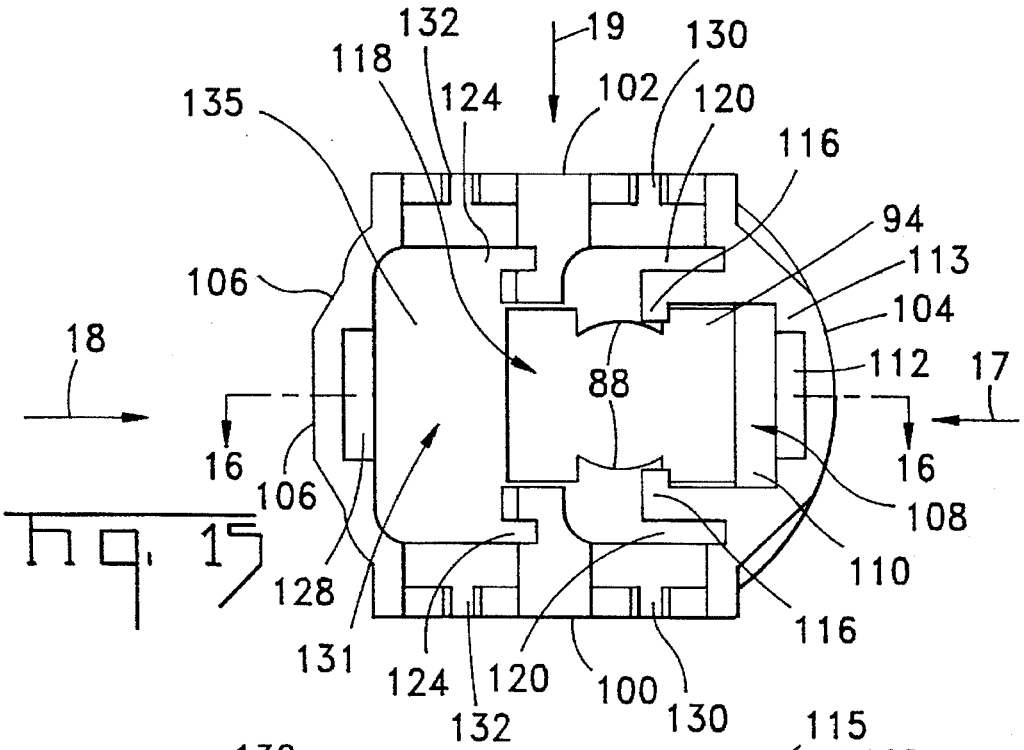
FIG. 15 is a top plan view of the housing.
Figure 16:
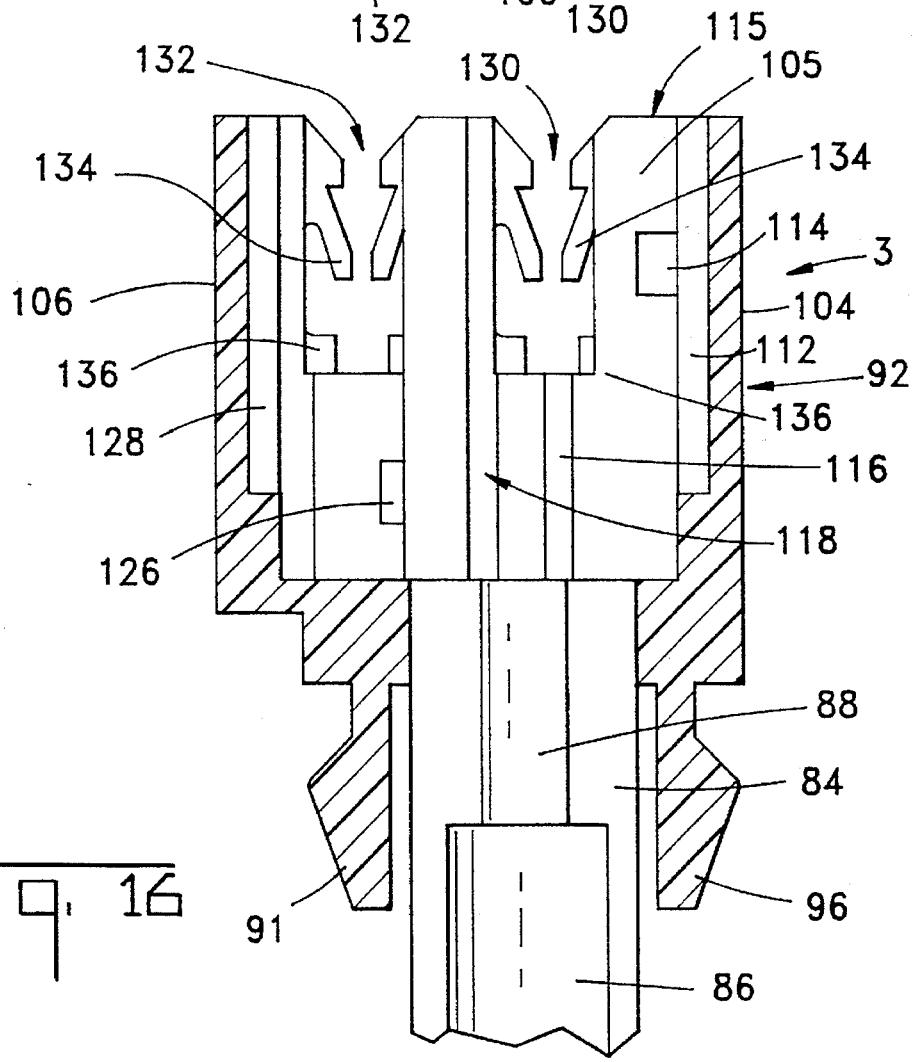
FIG. 16 is a view taken on the lines 16—16 of FIG. 15.
Figure 18:
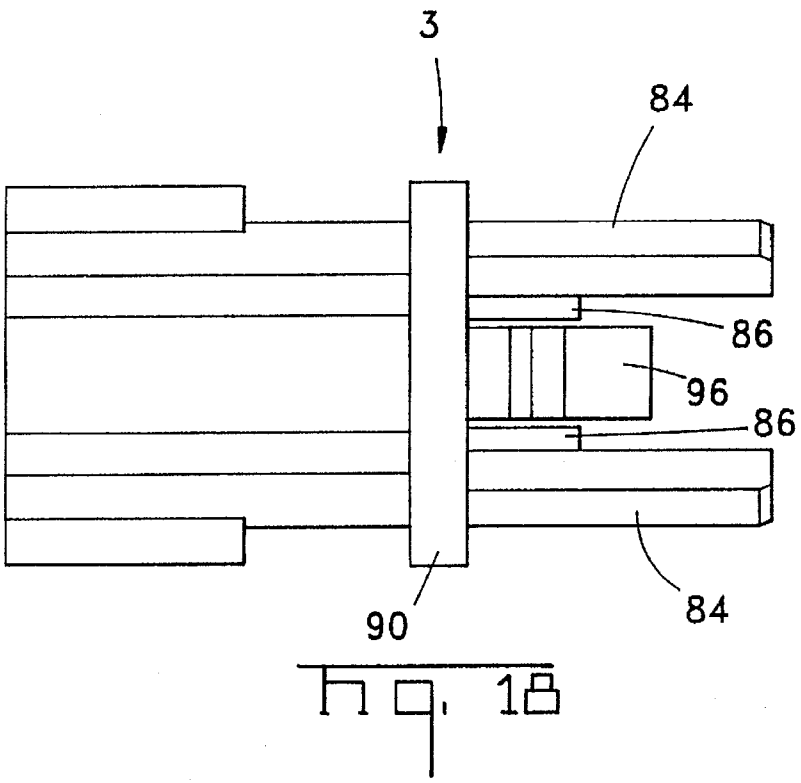
Figure 19:
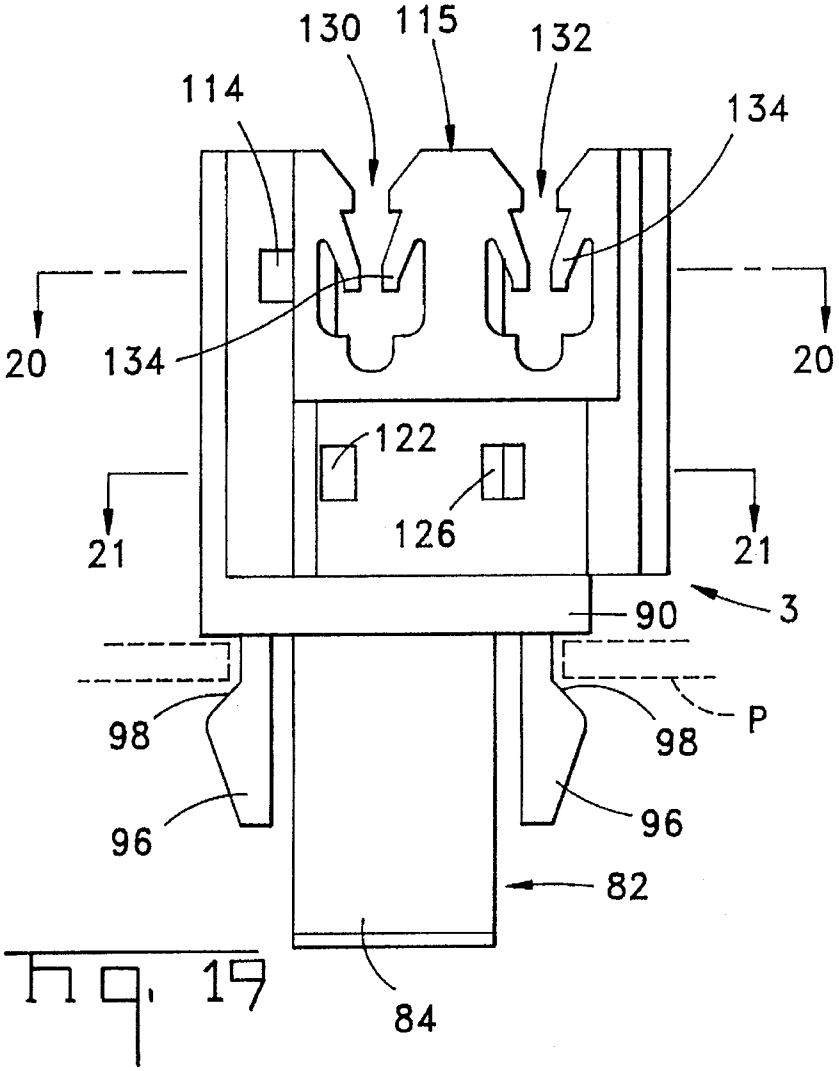
FIG. 19 is a view taken in the direction of the arrow 19 in FIG. 15.
Figure 27:
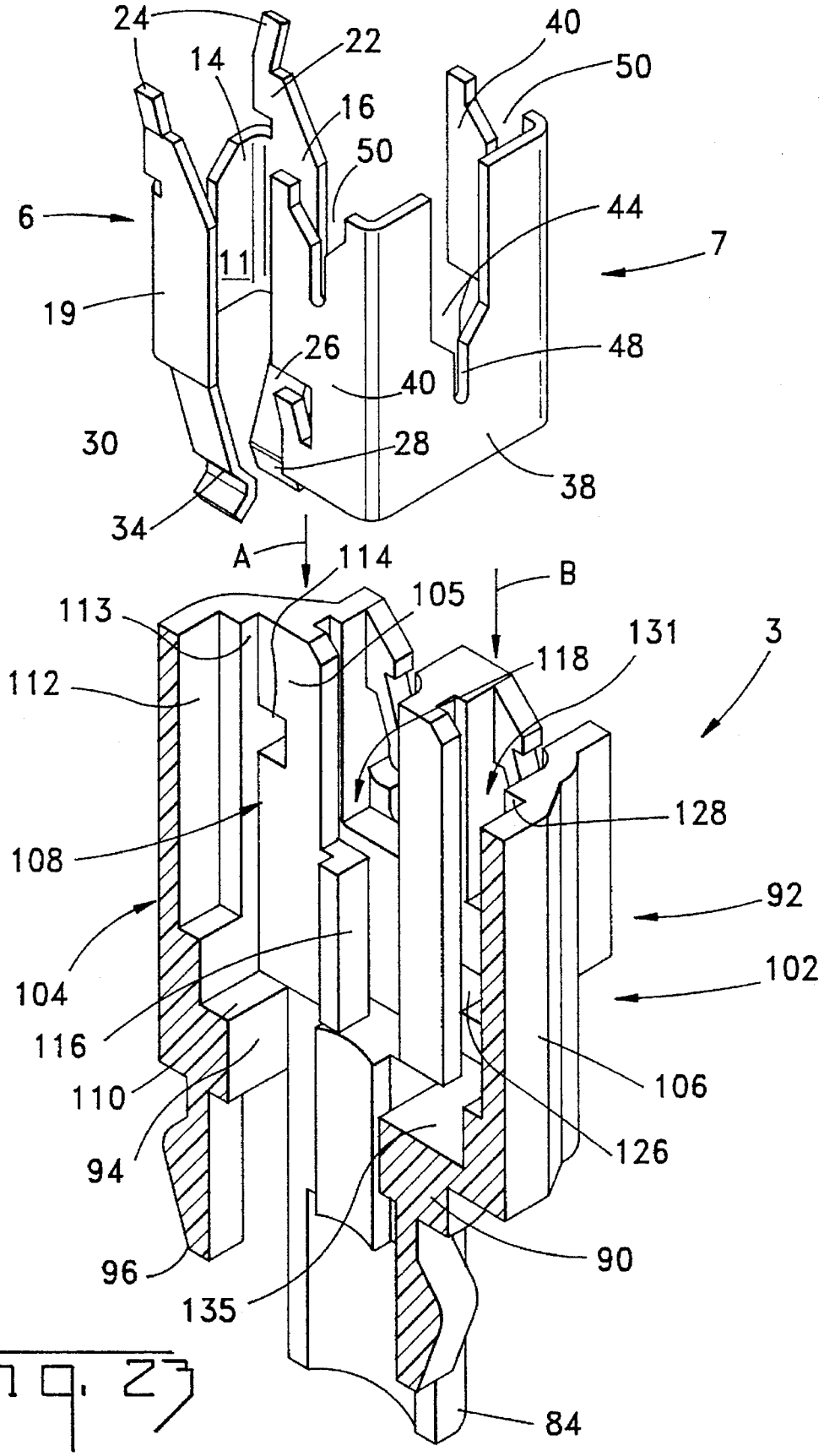
Figure 24:
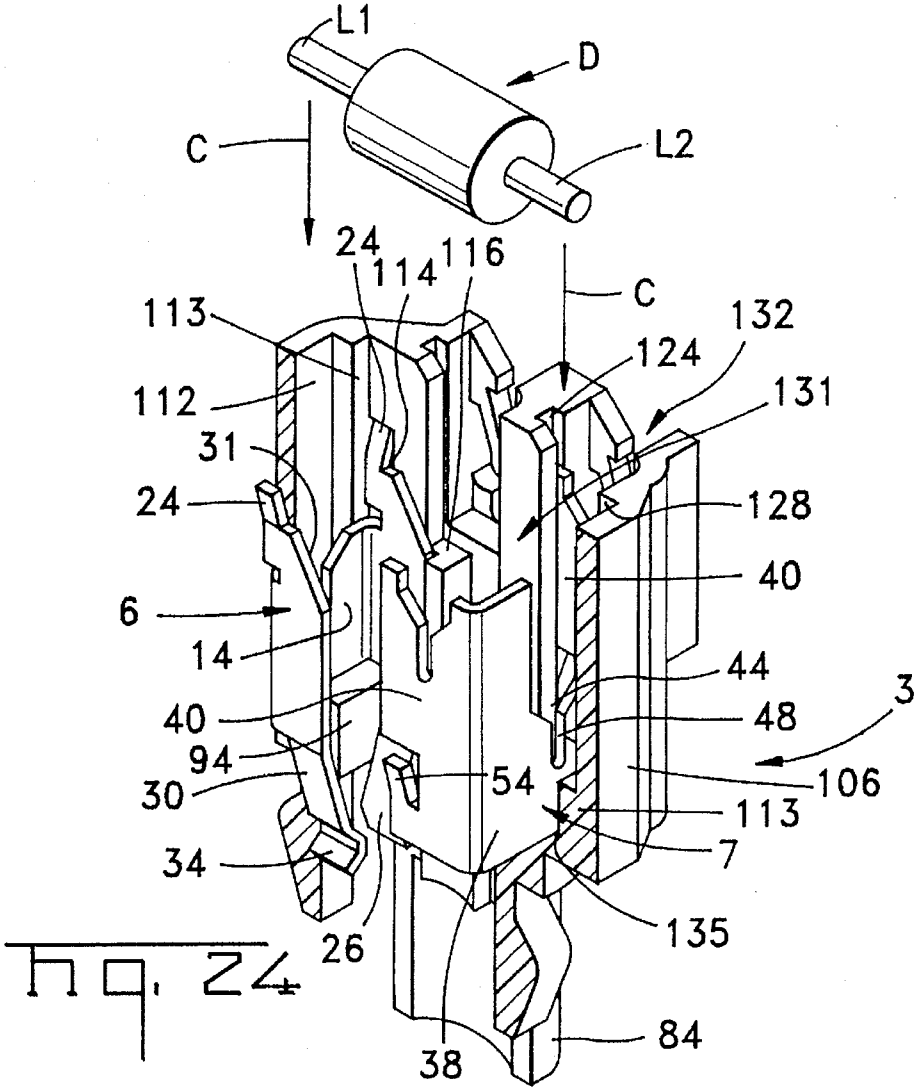
Figure 27:
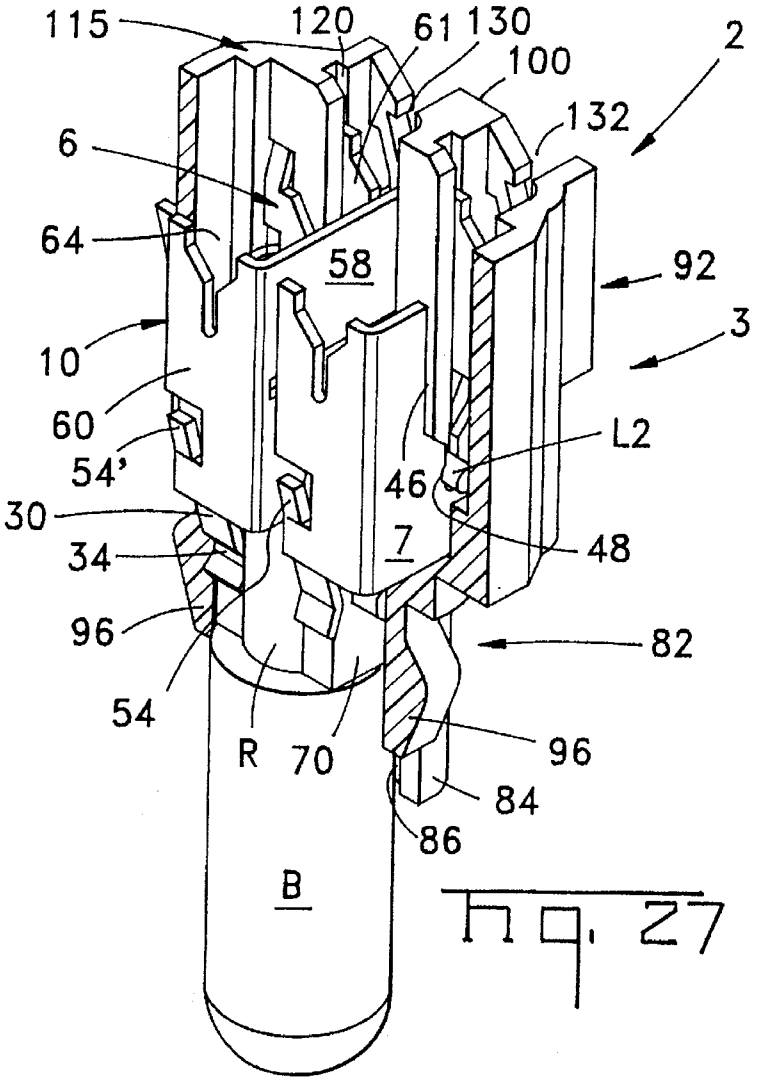
Figure 26:
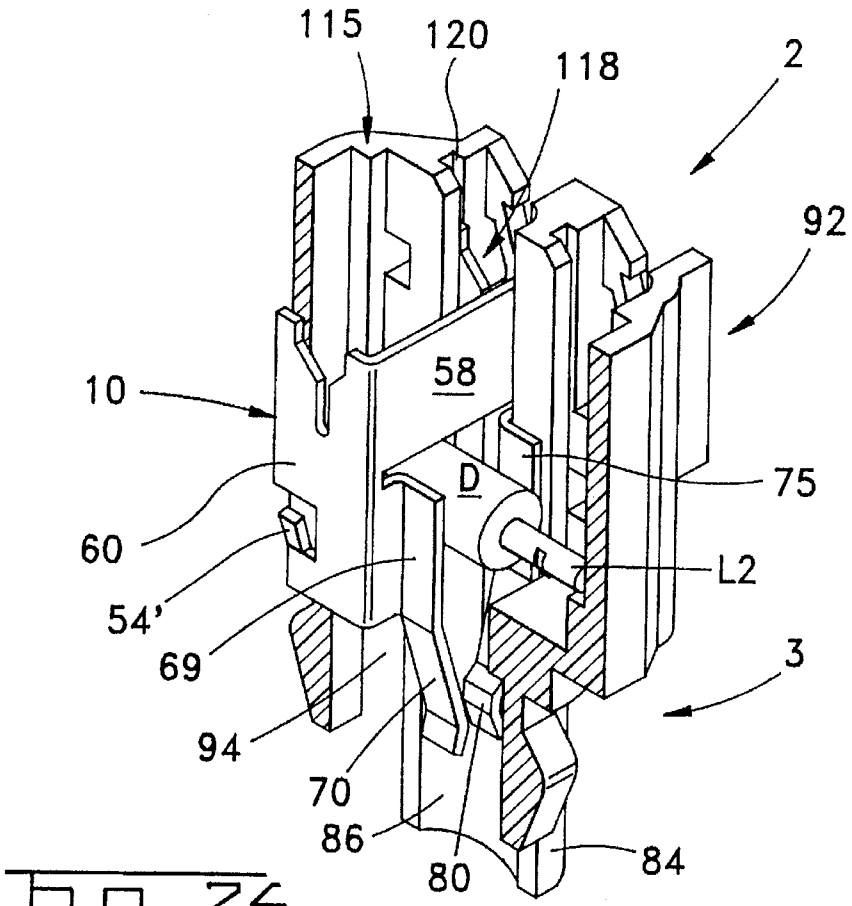

As shown in FIG. 1, a baseless electric lamp bulb B has contacts C1 and C2 for connection to supply leads by means of a lamp bulb holder 2 (FIGS. 26 and 27) which is described below. The bulb B comprises a cylindrical glass envelope E from which projects rearwardly, a generally flat and rectangular glass tail T supporting the contacts C1 and C2. The tail T has opposed central longitudinal, arcuate cross section ribs R. The contacts C1 and C2 are disposed on opposite faces of the tail T and are offset from each other on opposite sides of the rib R. The contacts C1 and C2 are connected by way of respective leads L to a coiled filament F within the envelope E. The lamp bulb holder 2 also connects in series with the bulb B, a circuit component in the form of a solid state diode D having a cylindrical body from opposite ends of which project bare wire leads L1 and L2 (FIG. 24). The purpose of the diode D is to block any back electromotive force which may be generated in the coiled filament F when the bulb B is switched off, in order to protect any voltage sensitive element to which the bulb B may be connected by means of the bulb holder 2.

Bulb holder 2 comprises an insulating housing 3 (FIGS. 14 to 27), a diode-to-bulb first electrical terminal 6 (best seen in FIGS. 2 to 5), a diode-to first supply lead second electrical terminal 7 (best seen in FIGS. 6 to 9) and a bulb-to-second supply lead electrical terminal 10 (best seen in FIGS. 10 to 13). The housing 3 was moulded in one piece from a suitable synthetic resin, and each of the terminals 6, 7 and 10 was stamped and formed from a single piece of sheet metal stock.

The first terminal 6 will now be described with reference to FIGS. 2 to 5. The terminal 6 comprises a substantially U-cross section body 11 having a base 14, and parallel side walls 16 and 19 joined to the base 14 by way of bights 20. There upstand from the upper ends of the walls 16 and 19, chamfered extensions 22 each terminating in a latching lug 24. There depends from the side wall 16 a contact spring beam 26 having an inwardly bowed contact surface 28 for engaging the bulb contact C1. The side wall 19 has depending therefrom a retention spring beam 30 having an inwardly directed joggle 34 having a flat retention surface 36 opposite to the contact surface 28 for engaging the opposite side of the bulb tail T to that on which the contact C1 is located. The base 24 has extending downwardly from its upper edge, a slot 31 for receiving the diode lead L1. The slot 31 has a mouth 35 for guiding the lead L1 between lead gripping edges 37 of the slot 31.

The second terminal 7 will now be described with reference to FIGS. 6 to 9. The terminal 7, which is of substantially U-cross section, has a base 38 having opposed, parallel side walls 40 joined to the base 38 by way of bights 42. A slot 44 for receiving the diode lead L2 extends downwardly from the upper edge of the base 38 and has an upper portion having parallel guide edges 46 and a lower portion having parallel lead gripping edges 48, more closely spaded than the edges 46, for gripping the lead L2. There extends downwardly from the upper edge of each side wall 40 a supply lead receiving slot 50 having a lead guiding mouth 51 communicating with an insulation displacing lower portion having edges 52 which are spaced for displacing the insulation of a first insulated supply lead L3 (FIG. 28) and making permanent electrical contact with the core of the lead. The slots 50 are aligned with each other. Towards its bottom end, each side wall 40 has an outwardly inclined detent 54.

Figure 28:
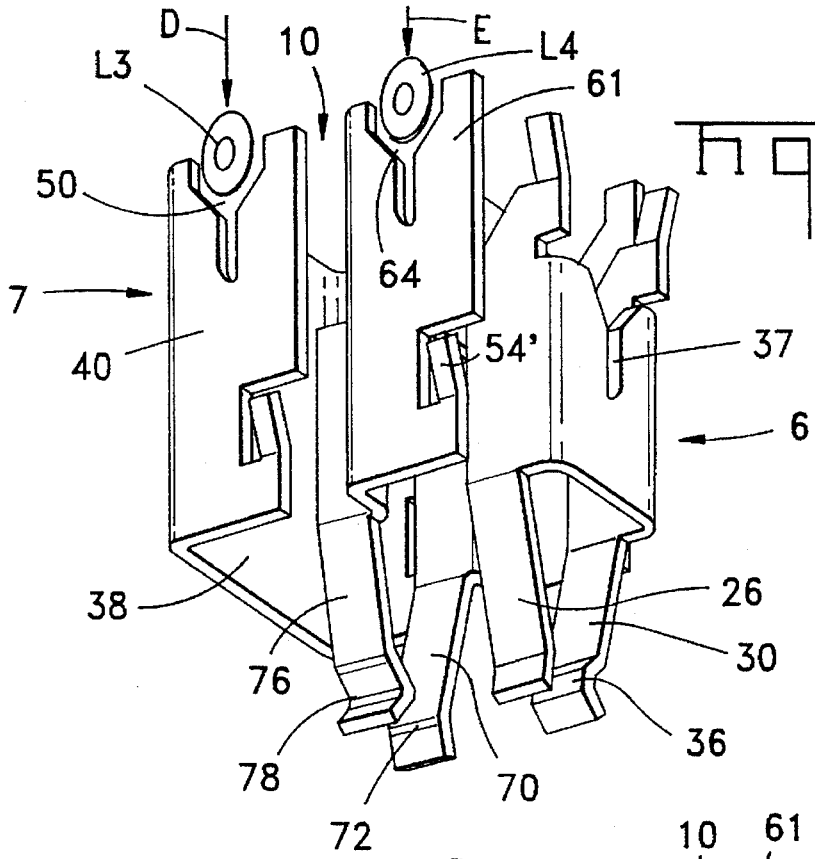
FIG. 28 is an isometric view showing the terminals in the relative positions that they occupy in the housing, the housing not being shown.

The third terminal 10 will now be described with reference to FIGS. 10 to 13. The terminal 10 has a substantially U-shaped end portion 56 having a flat base 58 and parallel side walls 60 and 61 joined to the base 58 by bights 62. Each side wall 60 and 61 has, extending from its upper end, a slot 64 for receiving a second supply lead L4 (FIG. 28). The slots 64 are shaped similarly to the slots 50 for the terminal 7 and are similarly aligned with each other. There depends from the side wall 60 an extension 66 to which is connected by a bight 68, a contact beam support plate 69 from which depends a spring contact beam 70 having an inwardly directed contact surface 72 for engaging the bulb contact C2. The side wall 61 has depending therefrom, an extension 74 to which is connected by a bight 78, a beam support plate 75 from which depends a retention spring beam 76 having a joggle 78 providing a flat retention surface 80, opposite to the contact surface 72, for engaging with the side of the bulb tail T opposite to that on which the contact C2 is located. Each extension 66 and 74 is formed with an upwardly and outwardly inclined detent 54'.

The housing 3 will now be described with reference to FIGS. 14 to 22. The housing 3 has a lower end portion providing a bulb socket generally referenced 82, having a pair of laterally spaced cheeks 84 depending from the housing 3 and each defining a first concave recess 86 for guiding a respective side of the cylindrical envelope E of the bulb B. A rib 87 above each recess 86 defines a second concave recess 88 coaxial with the first recess 86, for receiving a respective rib R of the bulb tail T, the recess 88 being accordingly of substantially smaller radius than the recess 86.

Figure 21:
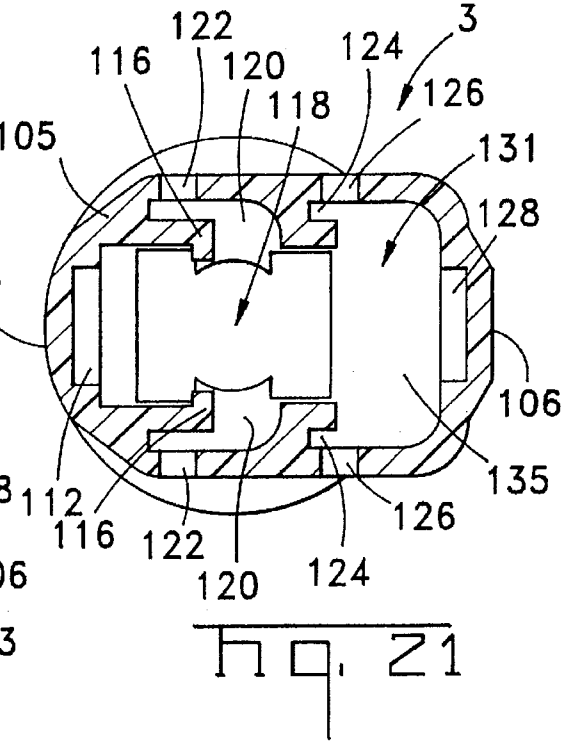
FIGS. 20 and 21 are views taken on the lines 20—20 and 21—21, respectively, in FIG. 19.
Figure 20:
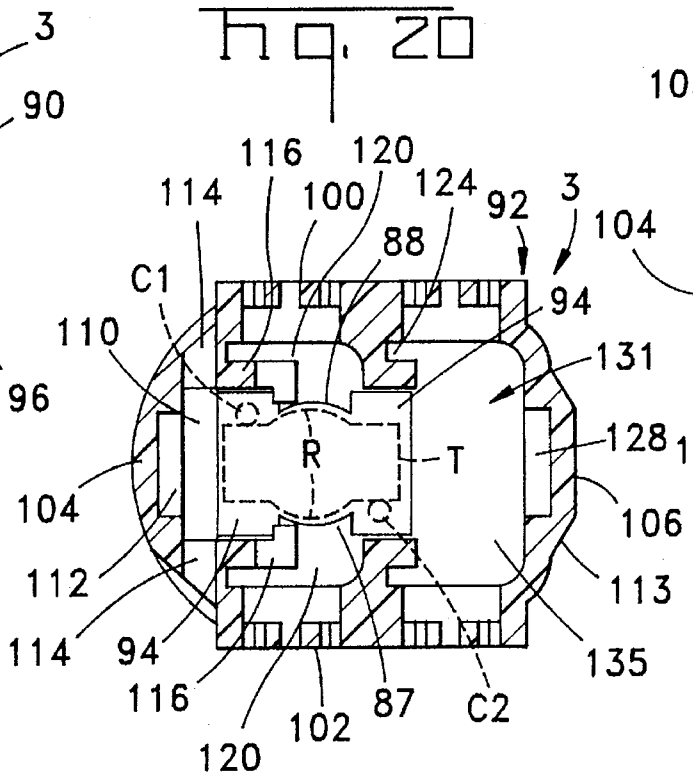
Figure 22:
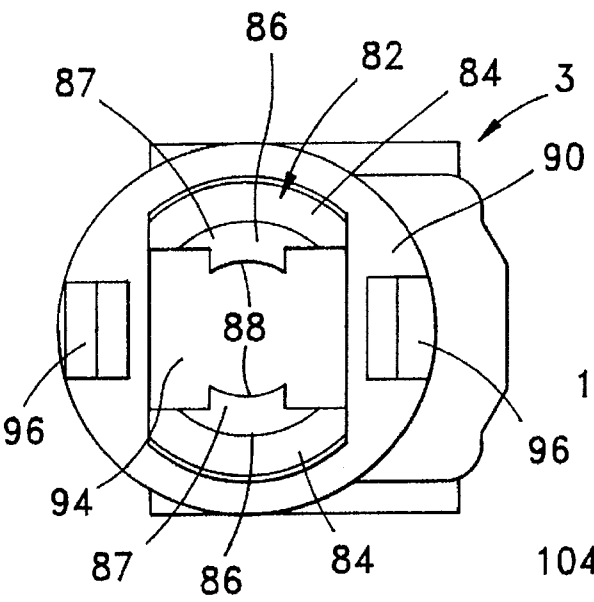
FIG. 22 is an underplan view of the housing.

The housing 3 has a terminal receiving upper part 92 having a bottom wall 90 defining a space 94 for receiving the rear end of the bulb tail T, with the contacts C1 and C2 of the tail T disposed on opposite sides of the ribs 87 as indicated in broken lines in FIG. 21. There depends from the bottom wall 90, between the cheeks 82, but being spaced laterally outwardly therefrom, a pair of opposed cantilever latch arms. 96 for insertion through a hole in a mounting panel P, indicated in broken lines in FIG. 19, so that the edge of the hole engages in external notches 98 in the latch arms 96 so to secure the housing 3 to the panel P. The arms 96 have tapered free end portions for guiding them through the hole in the panel.

The terminal receiving part 92 of the housing 3 comprises opposed side walls 100 and 102 and opposed end walls 104 and 106. The end wall 104 and opposite, rudimentary internal walls 105 of the housing part 92 define a first cavity 108 for receiving the body 11 of the terminal 6. The bottom wall 90 defines a step 110 at the bottom end of the wall 104 for supporting the bottom edge of the body 11 of the terminal 6. A rabbet 112 in the internal face of the wall 104 communicates with the cavity 108 to receive the free end of the diode lead L1. The rabbet 112 is bounded laterally, by beads 113 of the wall 104. Each wall 105 has a latching through opening 114 for latchingly receiving a respective lug 24 of the terminal 6. The cavity 108 opens at its upper end into the upper, terminal receiving end 115 of the housing 3 and at its lower end into the space 94. A truncated, L-section retaining arm 116 projects from each wall 105 for confining the edge of a respective side wall of the terminal 6. The cavity 108 communicates with a central, second terminal receiving cavity 118, which, in turn, communicates with first opposed, substantially L-cross section slots 120 for receiving the respective side walls 60 and 61 of the third terminal 10. The outer wall of each slot 120 has a through latching opening 122 (FIG. 16) for receiving a respective detent 54' of the terminal 10. The central cavity 118 further communicates with a third cavity 131 having two further substantially L-shaped opposed slots 124 for receiving the side walls 40 of the second terminal 7. The outer wall of each slot 124 has a latching through opening 126 for latchingly receiving a respective detent 54 of the terminal 7. The internal face of the end wall 106 is formed with a rabbet 128 opposite to the rabbet 112, for receiving the free end of the diode lead L2. The central cavity 118, the end cavity 131, the slots 120 and 124 and the rabbets 112 and 128 all open into the terminal receiving end 115 of the housing 3. The cavity 131 also opens, at its lower end, into the space 94 for receiving the bulb B. The cavity 131 communicates with the central cavity 118 and has a floor 135 for supporting the bottom edge of the base 38 of the terminal 7.

Each side wall 100 and 102 is formed with notches 130 for receiving the supply lead L3, the notches 130 being aligned with each other and with the slots 120. Each side wall 100 and 102 is also formed with a notch 132 for receiving the supply lead L4, these notches being aligned with each other and with the cavity 131. Each notch 130 and 132 opens into the terminal receiving end 115 of the housing 3 and is provided with supply lead retention barbs 134 and a lead wire seat 136.

Figure 25:
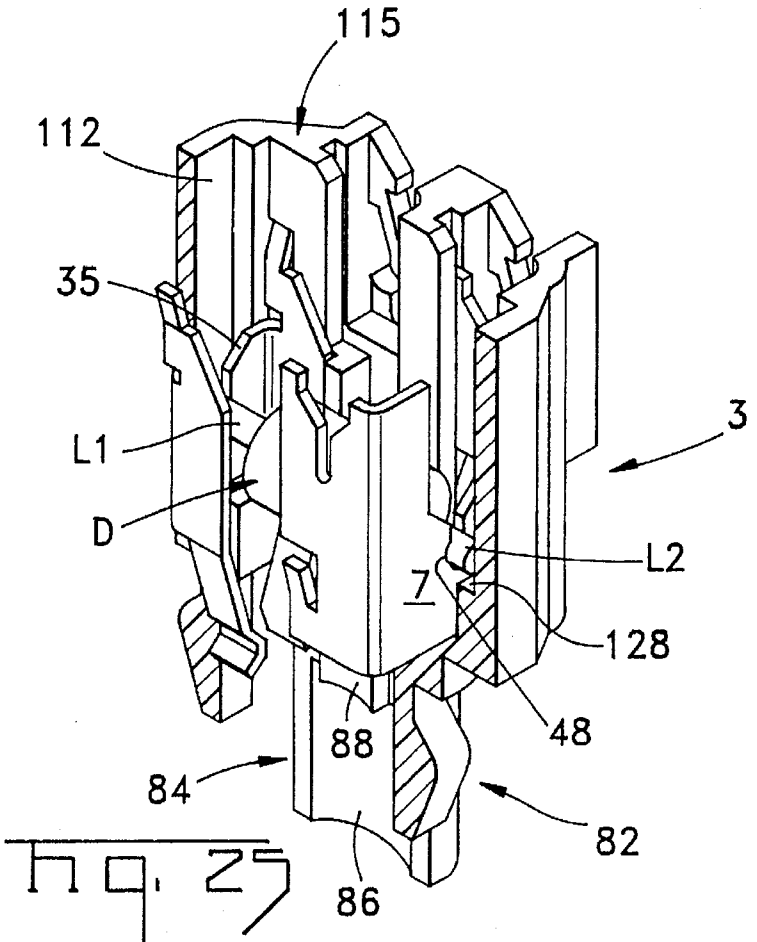
Figure 29:
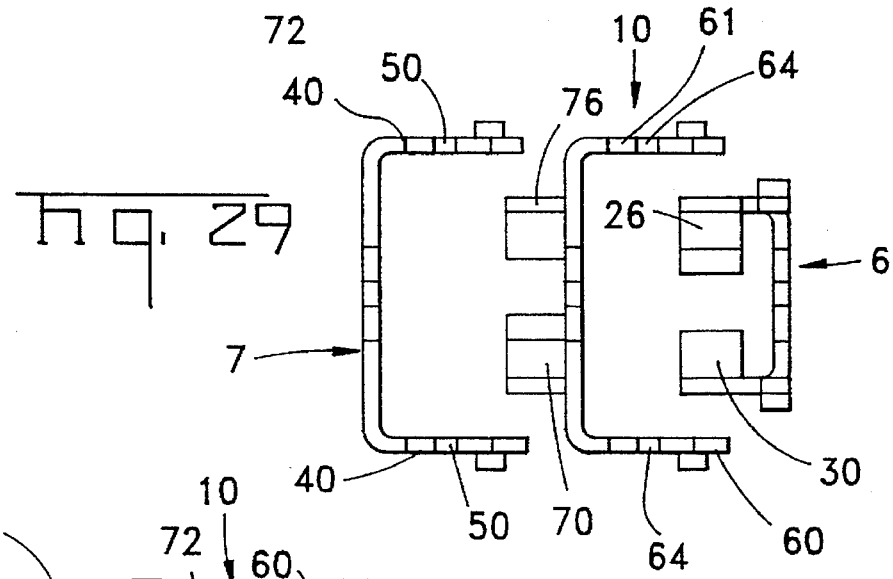
FIGS. 29 and 30 are top plan and under plan views, respectively, of the terminals shown in FIG. 28.
Figure 30:
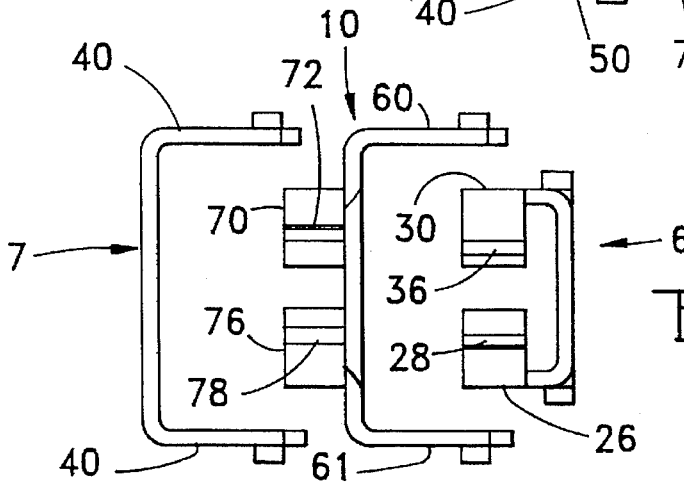

The operation of stitching the terminals and the diode into the terminal receiving part 92 of the housing 3, by means of a conventional terminal stitching machine (not shown), will now be described with reference to FIGS. 23 to 30. As shown in FIG. 23, the first and second terminals 6 and 7 are stitched first, and simultaneously, into the terminal receiving part 92 of the housing 3 in the direction of the arrows A and B, respectively, in FIG. 23. Upon full insertion of the terminal 6 into the first terminal receiving cavity 108, the latching lugs 24 of the terminal 6 latchingly engage in the openings 114 to prevent withdrawal of the terminal 6. The bottom edge of the base 14 of the terminal 6 rests upon the step 110 with the spring beams 26 and 30 projecting into the space 94 for receiving the bulb tail T, on one side of the cheeks 84. The base 14 of the body 11 abuts the beads 113 defining the rabbet 112, as shown in FIG. 24. The edges of the side walls 16 and 19 of the terminal 6 are engaged with respective ones of the retaining arms 116. The terminal 6 is accordingly confined by the housing against both vertical and lateral movement. The bottom edge of the base 38 of the terminal 7 rests on the floor 135 of the end cavity 131 with the side walls 40 of the terminals 7 received in respective ones of the slots 124. The base 38 of the terminal 7 abuts the internal surface of the housing end wall 106 in which the rabbet 128 is formed. The detents 54 engage latchingly in respective ones of the latching openings 126 so that the terminal 7 is secured against withdrawal from the cavity 131. The diode lead receiving slot 44 of the terminal 7 is aligned with the diode lead receiving slot 31 of the terminal 6 and the supply lead receiving slots 50 of the terminal 7 are aligned with the supply lead receiving notches 132 of the housing 3. The diode D is now stitched through the open top of the housing 3, in the direction of the arrows C in FIG. 24, to insert the lead L1 of the diode D between the lead gripping edges 37 of the slot 31 of the terminal 6, guided by the mouth 35 of the slot 31, and the lead L2 of the diode D between the lead gripping edges 48 of the slot 44 of the terminal 7. The leads L1 and L2 are thereby firmly gripped in the respective diode lead receiving slots so that the diode D is secured in the housing 6 whilst being firmly electrically connected to the terminals 6 and 7. The end of the lead L1 is accommodated in the rabbet 112, the end of the lead L2 being accommodated in the rabbet 128 (FIG. 25). The cylindrical body of the diode D spans the central cavity 118 of the housing part 92. As will be apparent from FIG. 26 (in which the terminals 6 and 7 are not shown) the terminal 10 is stitched into the central cavity 118 of the housing part 92, with the beams 70 and 76 leading. As the terminal 10 is inserted into the cavity 118, the contact surface 72 of the beam 70 and the retention surface. 80 of the beam 76 engage the body of the diode D so that the beams 70 and 76 are cammed apart and the contact surface 72 and the retention surface 80 pass the body of the diode D and pass into the space 94. As shown in FIGS. 28 to 30, the contact surface 28 of the beam 26 is then laterally aligned with the flat retention surface 80 of the beam 76 and the flat retention surface 36 of the beam 30 is laterally aligned with the contact surface 72 of the beam 70. The beams 26 and 30 lie on the opposite side of the cheeks 84, to the beams 70 and 76. The flat base 58 of the terminal 10 extends across the body of the diode D, which lies between the plates 69 and 75 of the terminal 10. The side walls 60 and 61 of the terminal 10 lie in respective ones of the slots 120, with the detents 54' latchingly engaged in the latching openings 122 in the slots 120 so that the terminal 10 is secured against withdrawal from the cavity 118. The supply lead receiving slots 64 in the side walls 60 and 61 lie in alignment with the supply lead receiving notches 130 in the 2housing side walls 100 and 102. As best seen in FIGS. 29 and 30 the beams 26 and 30 lie between the side walls 60 and 61 and the beams 70 and 76 lie between the side walls 40.

In order to prepare the bulb holder 2 for use, with the terminals 6, 7 and 10 stitched into the housing 6 as described above, the insulated supply leads L3 and L4 are forced into the respective supply lead receiving notches 130 and 132 and also into the respective supply lead receiving slots 50 and 64 in the direction of the arrows D and E, respectively, in FIG. 28. The insulation displacing edges of the slots 50 and 64 displace the insulation of the leads L3 and L4 and make permanent electrical contact with the metal cores of these leads. The supply leads L3 and L4 may be inserted into the supply lead receiving slots by means of suitable tooling or by means of a cover (not shown) for the open top of the housing 3, and being provided with wire stuffer members. The lamp bulb tail T is then inserted into the space 94 with the ribs R of the tail T received in the recesses 88 of the cheeks 84 (FIGS. 21 and 27), thereby to locate the tail T so that the contact surface 28 of the beam 26 engages the contact C1 of the bulb B, the retention surface 36 of the beam 30 applying a counter force to the opposite side of the tail T and the contact surface 72 of the beam 70 engages the bulb contact C2, the retention surface 80 of the beam 76 applying a counter force to the opposite side of the tail T. The tail T is thus resiliently engaged between beams, with the diode D connected in series with the bulb B.

In use, the lamp holder 2 is latched to the panel B, for example in a gaming machine, as described above with reference to FIG. 19 and the leads L3 and L4 are connected to semiconductor switches in the machine for switching the lamp bulb on and off. Any back electromotive force generated by the magnetic flux about the coiled filament F, when the bulb is switched off, will be blocked by the diode D thereby projecting the semiconductor switch.

I claim:

1. A holder for a lamp bulb, comprising an insulating housing having a terminal receiving part and a socket for receiving the lamp bulb, the terminal receiving part defining first, second and third terminal receiving cavities opening into a terminal receiving end of the housing and receiving first, third and second electrical terminals, respectively, the first and third terminals each having a spring contact beam projecting into the socket for engaging a respective contact of the lamp bulb, the first and second terminals each having a component lead receiving slot securely receiving a respective lead of an electrical component and the second and third terminals each having at least one supply lead receiving slot, all of said component lead receiving slots and supply lead receiving slots opening towards the terminal receiving end of the housing where the electrical component is disposed within the housing.

2. A lamp bulb holder as claimed in claim 1, wherein each of the first and third terminals has a spring retention beam for cooperation with a contact spring beam of the terminal to retain the lamp bulb in the socket.

3. A lamp bulb holder as claimed in claim 2, wherein the third terminal has a pair of side walls spanned by a plate which extends across the electrical component.

4. A lamp bulb holder as claimed in claim 3, wherein the second terminal receiving cavity is intermediate the first and third terminal receiving cavities and communicates therewith, the first terminal being latched against a first end wall of the housing and the second terminal being latched against a second and opposite wall of the housing, the second and third terminals having side walls lodged in opposed slots in opposite side walls of the housing and communicating with the third and the second terminal receiving cavities.

5. A lamp bulb holder as claimed in claim 4, wherein the spring contact beam of the first terminal lies between the side walls of the third terminal and the spring contact beam of the third terminal lies between the side walls of the second terminal.

6. A lamp bulb holder as claimed in claim 5, wherein each of the first and second end walls is formed with a rabbet opening into the terminal receiving end of the housing and receiving the end of a respective lead of the electrical component.

7. A lamp bulb holder as claimed in claim 1, wherein the socket comprises a pair of spaced cheeks depending from the terminal receiving part of the housing and each defining a first concave recess for guiding a respective side of the lamp bulb, a rib extending from each cheek into a space defined by a wall of the terminal receiving part of the housing and defining a second concave recess, coaxial with, but of smaller radius than, the first concave recess, for locating a contact bearing tail of the lamp bulb relative to contact surfaces of the spring contact beams.

8. A lamp bulb holder as claimed in claim 1, wherein the electrical component is a solid state diode comprising a body from opposite ends of which project are wire leads.

9. The lamp bulb holder of claim 1 wherein the first, second and third terminal receiving cavities are defined such that the terminals are inserted therein by linear movement in the same direction as required for insertion of the electrical component into the component lead receiving slots.

10. A method of assembling a holder for a lamp bulb, the method comprising the steps of;

providing an insulating housing having a terminal receiving part and a socket for receiving the lamp bulb, the terminal receiving part of the housing defining first, second and third successively arranged terminal receiving cavities opening into a terminal receiving end of the housing;

inserting into the first cavity, by way of said terminal receiving end of the housing, a first electrical terminal having a first spring contact beam and a first component lead receiving slot, so that the spring contact beam projects into the socket of the housing for engaging a first contact of the lamp bulb and the component lead receiving slot opens towards the terminal receiving end of the housing;

inserting into the third cavity, by way of said terminal receiving end of the housing, a second electrical terminal having a second component lead receiving slot and a first supply lead receiving slot, so that both of the slots open towards a terminal receiving end of the housing;

inserting into the component lead receiving slots of the first and second terminals by way of the terminal receiving end of the housing, respective leads of an electrical component, so that the leads are gripped by the edges of the component lead receiving slots such that the component is disposed within the housing; and inserting into the second cavity, by way of the terminal receiving end of the housing, a third electrical terminal, having a second supply lead receiving slot and a second spring contact beam, so that the second supply lead receiving slot opens towards the terminal receiving end of the housing and the spring contact beam projects into the socket of the housing for engaging a second contact of the lamp bulb.

11. A method as claimed in claim 10, wherein a second spring contact beam engages the component as the third terminal is being inserted into the second cavity, is cammed aside by the component and passes the component before it projects into the socket of the housing.

12. A method as claimed in claim 11, wherein the third terminal has a plate which extends across the component when the third terminal has been inserted into the second cavity, and extends across the second cavity.

13. A method as claimed in claim 12, wherein the third terminal has a spring retention beam for cooperation with the second spring contact beam to grip a tail of the lamp bulb and the second spring contact beam and the spring retention beam are cammed apart from one another by the component, as the third terminal is being inserted into a second cavity.

14. The method of claim 10 wherein all inserting steps occur with the motion along a common linear direction.

* * * * *